United States Patent [19]

Ashton

[11] Patent Number: 4,706,422

[45] Date of Patent: Nov. 17, 1987

[54] SPACE DIVIDER

[76] Inventor: Geoffrey B. Ashton, 26 Chesser Street, Adelaide, Australia, 50000

[21] Appl. No.: 845,697

[22] PCT Filed: Jul. 2, 1985

[86] PCT No.: PCT/AU85/00145

§ 371 Date: Mar. 4, 1986

§ 102(e) Date: Mar. 4, 1986

[87] PCT Pub. No.: WO86/00658

PCT Pub. Date: Jan. 30, 1986

[30] Foreign Application Priority Data

Jul. 6, 1984 [AU] Australia ..... PG5875

[51] Int. Cl.[4] ..... E04B 1/82; E04C 2/34; E04C 2/38

[52] U.S. Cl. ..... 52/145; 52/144; 52/221; 52/794; 52/802; 52/813; 52/815; 52/818; 52/822; 181/284; 181/291

[58] Field of Search ..... 52/145, 144, 221, 458, 52/455, 273, 179, 794, 802, 813, 815, 818, 822; 181/284, 291

[56] References Cited

U.S. PATENT DOCUMENTS

| | | | |
|---|---|---|---|
| 2,350,513 | 6/1944 | Leadbetter | 52/145 |
| 3,070,186 | 12/1962 | Meek | 51/144 |
| 3,195,698 | 7/1965 | Codrea | 52/221 |
| 3,963,094 | 6/1976 | Nowikas | 52/144 |
| 4,020,604 | 5/1977 | Legler et al. | 52/221 |
| 4,391,073 | 7/1983 | Mollenkopf et al. | 52/221 |

FOREIGN PATENT DOCUMENTS

| | | | |
|---|---|---|---|
| 2458835 | 6/1976 | Fed. Rep. of Germany | 52/145 |
| 2513317 | 9/1976 | Fed. Rep. of Germany | 52/145 |
| 3012514 | 10/1981 | Fed. Rep. of Germany | 52/145 |
| 3202078 | 8/1983 | Fed. Rep. of Germany | 52/145 |
| 345551 | 1/1937 | Italy | 52/144 |
| 610973 | 5/1979 | Switzerland | 52/143 |
| 905437 | 9/1962 | United Kingdom | 52/145 |
| 1013587 | 4/1983 | U.S.S.R. | 52/144 |

*Primary Examiner*—William F. Pate, III
*Assistant Examiner*—Michael Safavi

[57] ABSTRACT

A space divider of generally rectangular shape having perforated walls (1–8) with two opposite edges inturned to mate to form cavities (6) to hold acoustic bats (7) therebetween and including intersecting stiffeners (4–5) and means (16) to hold a pull-over fabric cover and including apertures (15–24) in end closures (11–22) to engage forming and locating means for the panels and for attaching shelving.

7 Claims, 4 Drawing Figures

SPACE DIVIDER

This invention relates to a space divider and in particular it relates to a space divider of the type already commonly known which comprise members which can be arranged on a floor and generally are self-supporting, using a series of panels which can be positioned in a manner to have the required stability and which are joined together by joining members which allow connection of panels either in line or at angles to a panel these members conveniently comprising plates with pins projecting therefrom which engage apertures in the panels which are to be joined, at least two pins engaging each panel to give the required stability and to allow joining in different ways.

One of the problems with space dividers of this type is that their construction is generally of wood with fabric covering and while the panels are satisfactory in that they can be constructed to have good acoustic properties, their construction as used heretofore generally does not render them fire-proof and therefore not acceptable under some conditions where high fire ratings must be achieved.

Reference may be had to my earlier inventions which related generally to space dividers, see Australian Registered Design No. 65423 and British Letters Patent No. 1600990 and Australian Patent Application No. 26628/84.

It is the object of this invention to provide space dividers comprising panels so arranged that adequate fire resistance can be obtained in a highly effective form of space divider which is both durable and of economical construction and which can be assembled in a ready manner to produce the individual panels which form such space divider.

The panel according to this invention is constructed chiefly of non-inflammable material and utilises side walls with acoustic characteristics spaced apart a required distance and held by upper and lower lock members, the covering of the panel, such as a covering of wool fabric or the like, being formed independently of the panel and drawn over the panel preferably to allow removal of the cover if this is required for cleaning or other purposes, the panel preferably having a skirting member which also forms the electrical conduit means and means to allow the panel to be positioned and located in position.

Figure 1:
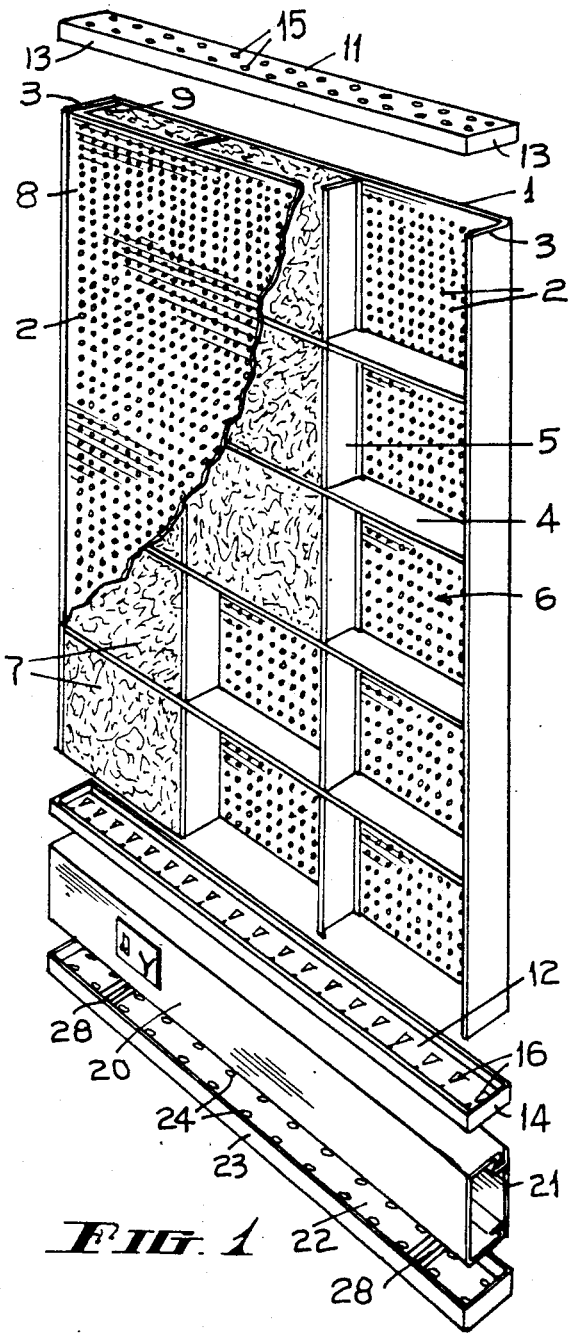
Figure 2:
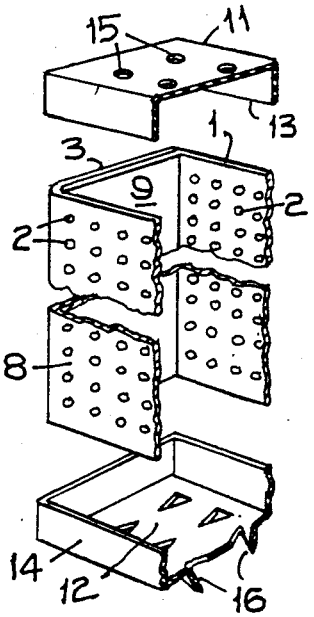
Figure 3:
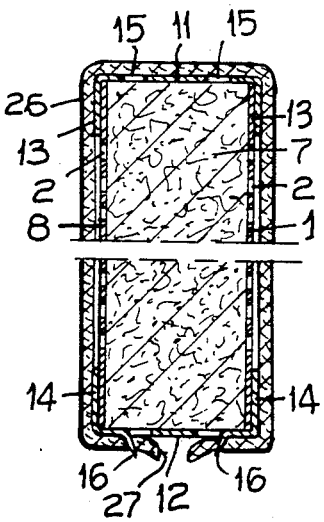
Figure 4:
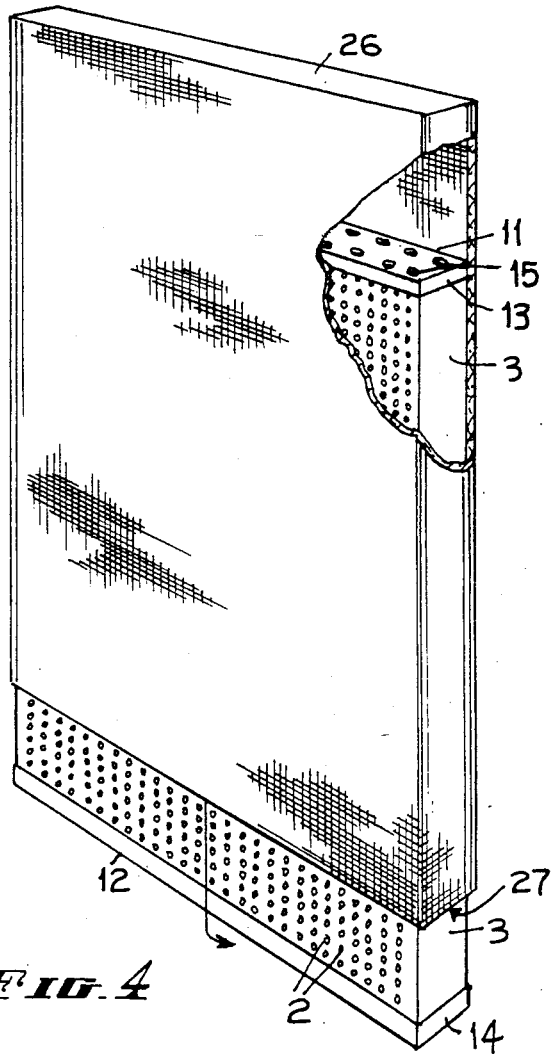

The actual construction of such a panel can be somewhat varied but to enable the nautre of the invention to be fully appreciated a preferred embodiment thereof will now be described with reference to the accompanying drawings in which:

FIG. 1 is an exploded part sectional perspective view of the components which make up the panel but omitting the fabric or similar covering, FIG. 2 is a fragmentary perspective view of a portion of the panel showing the main support members of the panel, FIG. 3 is an enlarged fragmentary cross section of the panel showing the position of the fabric or similar cover over the members of the panel, and FIG. 4 is a part sectional view of the main frame of the panel showing the fabric cover being pulled into position over it prior to tensioning the cover.

The panel has a first side wall 1 which is constructed to have a series of apertures 2 through it for acoustic purposes and is of generally channel shaped cross section having two end portions 3 turned at right angle to the face of the wall formed by the panel and having a series of intersecting stiffeners 4 and 5 of a dimension to fit neatly into the space formed by the end portions 3.

This construction of the first side wall then forms a series of cavities 6 into which acoustic bats 7 are placed and these are held in place by a second wall 8 also having inturned end portions 9 but the second wall 8 is of slightly greater width than the first side wall 1 so that the inturned end portions of the first side wall lie against the inturned end portions of the second side wall so that the second side wall forms, as it were, a cover member enclosing the cavity 6 and thus confining the acoustic bats 7, this second side wall also having apertures 2 through it to give the necessary acoustic assembly.

The first side wall 1 and the second side wall 8 are held together by an upper lock member 11 and a lower lock member 12 each of which members is in the form of a channel, the upper lock member 11 having downturned edges 13 which are adapted to fit over and engage the tops of the first and second side walls, while the lower lock member 12 has upturned edges 14 which again fit over and engage the lower portions of the first and second side walls 1 and 8 so that when the lock members 11 and 12 are in position a sealed assembly results which has in effect an acoustic infill panel formed by the bats 7 and is of the required strength and rigidity because of the stiffeners 4 and 5.

The upper lock member has a series of apertures 15 through its wall which are adapted to engage pins used to hold a series of these panels together in a manner similar to that known heretofore but the apertures 15 extend along the complete length of the upper lock member so that other panels can be joined at any required locality or panels can be interconnected endwise.

The lower lock member 12 is provided with a series of downwardly projecting tangs 16 which serve as the means for locking the fabric cover in position as will be later described, these tangs being arranged in two somewhat inwardly facing rows as shown more particularly in FIGS. 2 and 3 to allow the fabric to be pulled over and caught thereon.

The skirting assembly 20 forms a service and can be of any usual or approved construction and preferably is in the nature of a longitudinally extending box having a cover 21 along one side or along part of a second side, this skirting being arranged to serve as an electrical conduit or to carry wiring or other fittings which are to be associated with the particular panel of the space divider. The cover can clip in place or be formed to clip into position as shown.

The skirting assembly 20 has fixed to it a base member 22 which has upturned edges 23 which engage the skirting 20 and this base member preferably has a series of apertures 24 which are similarly arranged and spaced to the apertures 15 of the upper lock member 11 so that again interconnecting members with the necessary pins can be used to allow both the tops of the panels of the space divider and the bottoms of the panels of the space dividers to be interconnected with adjacent panels. The skirting member may be fixed to the lower lock member 12 by screws.

The outer fabric covering 26 which may be of wool cloth or the like is formed as shown more particularly in FIGS. 3 and 4 from which it will be seen that the fabric cover is in the nature of a bag which can be pulled over the panel formed according to the above described system and in FIG. 4 the cover is shown partly pulled down over the panel while FIG. 3 shows how after the fabric has been pulled down completely to cover the panel the open mouth 27 of the fabric cover has the fabric pulled inwardly and caught over the tangs 16 projecting from the lower lock member so that the fabric is then held in a taut position to entirely cover the panel yet is removable by releasing the fabric from the tangs if at any time this is required.

It would of course be possible if that were preferred to have the panel constructed with one or more zip fasteners or the like extending down the sides of the structure so that it could be placed into position and locked by interengaging the zip members instead of pulling the cover over the panel when formed in the nature of an open mouthed bag but it will be realised from the foregoing that a readily assembled panel is formed by this invention in that it is only necessary to place the acoustic bat 7 into the cavity 6 of this first side wall and to then place the second side wall 8 over it and lock the two together by positioning the upper lock member 11 and the lower lock member 12 over the upper and lower edges of the first and second side walls 1 and 2 and the whole structure just described can then be permanently locked together by screws or the like passed through the edges 13 and 14 of the upper lock member 11 and the lower lock member 12 respectively.

The whole assembly is also held firmly together by the fabric cover 26 when it is drawn in place and it will be realised that because of the particular construction described the cover can be tensioned very satisfactorily over the panel so formed instead of having to attach it by gluing or the like and thus allows the cover to be removed if necessary for cleaning or other purposes.

The skirting 20 can be attached by screws or the like to the lower lock member 12 after the fabric 26 has been pulled over and locked on the tangs 16 and this then ensures that the mouth of the bag formed by the fabric is effectively held and cannot leave the tangs.

The base member 22 may have brackets 28 as shown in FIG. 1 into which screws can be passed from the skirting 20 to complete the locking together of the whole assembly.

The apertures 15 in the upper lock member 11 can also receive pins or brackets arranged to extend down the outer face of the space divider and carrying shelves.

From the foregoing it will be realised that a very simple and effective form of space divider is provided in which the panels are relatively non-inflammable as it is possible to use fabric covering treated to reduce fire hazard and there is no use of inflammable material in the structure itself which can readily be formed by cutting and stamping or the like of the components which make up the panel.

The claims defining the invention are as follows:

1. A space divider of generally rectangular shape comprising: a first side wall (1) and a second side wall (8) spaced apart by inturned end portions (3,9) along only two opposite sides which overlap to form two side closures for the panel, a multiplicity of apertures (2) in the said side walls, an upper lock member (11) and a lower lock member (12) engaging the ends of the said side walls (1–8) and cooperating with said two side closures to form a perimeter frame around the said side walls, intersecting stiffeners (4–5) between said first wall (1) and the second wall (8) to form cavities (6) therebetween, acoustic batts (7) in the said cavities whereby to form a rigid acoustic panel, and a fabric cover (26) fitting over the said rigid acoustic panel, said fabric cover (26) comprising two faces to cover the said first (1) and second (8) side wall and said faces being joined around three sides of the fabric cover to fit the perimeter frame, whereby the said fabric cover (26) has, a sack-like configuration with a mouth (27) to permit it to be pulled over the said rigid acoustic panel.

2. A space divider according to claim 1 characterised in that the first side wall (1) and second side wall (8) are formed of sheet metal and the said fabric cover (26) is formed of a sound absorbing material.

3. A space divider according to claim 2 characterised in that the said sound absorbing material (26) is wool cloth.

4. A space divider according to claim 1 characterised by apertures (15) in one lock member (11) which is uppermost when the panel is upstanding, and by tangs (16) on the other said lock member to engage the said cover adjacent its mouth (27) when pulled over the said acoustic panel.

5. A space divider according to claim 1 characterised by a skirting member (20) forming conduit means engaged by the said lower lock member (11) and by a base member (22).

6. A space divider according to claim 1 further characterised by apertures (15) in the said upper lock member (11) spaced to receive pins arranged to hold a plurality of said space dividers together or to engage pins or shelving brackets and by downwardly directed tangs (16) in the said lower lock member (12), and by a base member (22) spaced from the said lower lock member (12) by a skirting assembly (20) attached to the said base member (22) and to the said lower lock member (12).

7. A space divider according to claim 6 characterised by apertures (24) in the said base member (22) spaced similarly to the apertures (15) of the said upper lock member (11) and arranged to receive pins arranged to hold a plurality of said space dividers together or to engage pins or shelving brackets.

* * * * *